US005448457A

United States Patent [19]

Adjeleian

[11] Patent Number: 5,448,457

[45] Date of Patent: Sep. 5, 1995

[54] HANDS-FREE DOCUMENT HOLDING DEVICE FOR A FLASHLIGHT

[76] Inventor: Michael Adjeleian, 50 Oakland Ave., Providence, R.I. 02908

[21] Appl. No.: 24,734

[22] Filed: Mar. 1, 1993

[51] Int. Cl.[6] ..... F21L 7/00; F21L 15/14

[52] U.S. Cl. ..... 362/98; 362/191; 362/208

[58] Field of Search ..... 362/98, 99, 202, 190, 362/191, 208

[56] References Cited

U.S. PATENT DOCUMENTS 2,685,638 8/1954 Littrell ..... 362/99
2,779,865 1/1957 Hermeyer et al. ..... 362/99
3,309,514 3/1967 Levy et al. ..... 362/99
4,739,457 4/1988 Orr ..... 362/190

FOREIGN PATENT DOCUMENTS 300947 10/1917 Germany ..... 362/98
287015 3/1928 United Kingdom ..... 362/98

*Primary Examiner*—Ira S. Lazarus
*Assistant Examiner*—L. Heyman
*Attorney, Agent, or Firm*—Bruce Jacobs

[57] ABSTRACT

A flashlight having a means attached thereto for holding and thereby illuminating an item such as a small document.

4 Claims, 3 Drawing Sheets

HANDS-FREE DOCUMENT HOLDING DEVICE FOR A FLASHLIGHT

FIELD OF THE INVENTION

This invention pertains to flashlights and flashlight attachments.

BACKGROUND OF THE INVENTION

The use of a flashlight for illumination is frequently accompanied by a need to hold or otherwise fix or immobilize an item such as a document in need of illumination. A person faced with such a need may be forced to hold the document to be illuminated in one hand while holding the flashlight to be used for illumination in the other. Under some circumstances a flashlight user may need to both hold or immobilize the document to be illuminated while keeping at least one hand free for another purpose. In these instances the flashlight user may precariously support either the flashlight or object to be illuminated between the chin and breastbone, hold one or the other under the arm, or even support the flashlight within the teeth or mouth. Even for individuals who have achieved proficiency in these alternative methods of supporting a flashlight, the methods remain inconvenient and given the choice, most flashlight users elect to use both hands to support the flashlight and document to be illuminated.

The options available for use of a flashlight to illuminate a document which must be held can be particularly disadvantageous in certain circumstances. For instance, a law enforcement officer may compromise his or her personal safety when attempting to read a document such as a motorist's driver's license at night. The officer must either use both hands to illuminate the license with the flashlight and thus have no free hand for use of their handgun, or else compromise their line of vision and/or ability to illuminate the license by holding the flashlight in one of the alternative methods described above. While flashlights with attachments for holding objects such as a doctor's tongue depressor (U.S. Pat. No. 3,900,924) have been developed, such devices are not designed to and can not hold documents in a manner so that they are illuminated and can be read by the user of the device.

Therefore there is a need for a means to enable a flashlight user to hold and illuminate a document while keeping at least one hand free.

SUMMARY OF THE INVENTION

The present invention is directed to a flashlight for holding and illuminating documents comprising a flashlight and a means attached thereto for holding a document such as a driver's license in a position so that it may be illuminated by the flashlight when in use. As a result, the flashlight enables the user to illuminate an item without the need to use two hands. The holding means according to the present invention may be mounted in a fixed position or adjustably mounted to the flashlight enabling adjustment to obtain proper lighting of various size documents. Generally, the holding means extends outwardly beyond the front illuminating end of the flashlight, generally parallel to thereto.

The flashlight is particularly useful in holding and illuminating small documents such as driver's licenses, motor vehicle registration and insurance documents, road maps, printed notes and operating instructions.

The flashlight is preferably most useful as an illuminating device for policemen examining a motorist's driver's license, registration and insurance card while keeping one hand free. The invention is particularly applicable to hand-held flashlights.

DETAILED DESCRIPTION OF THE INVENTION

Figure 1:
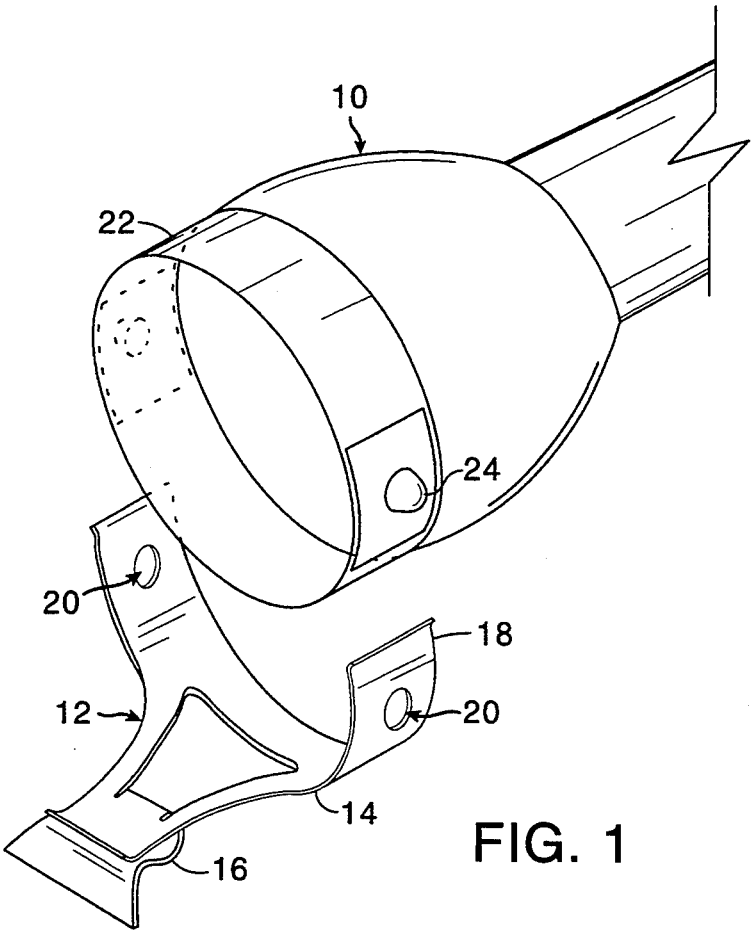
FIG. 1 is a perspective view depicting a document holding device of the present invention featuring unitary construction.

Referring to the drawings, FIG. 1 shows a flashlight 10 and a means 12 for holding a document for attachment thereto. As shown, the holding means comprises a support member 14 and a gripping member 16 connected thereto. The support member comprises a flexible semicircular portion 18 having opposed holes 20. In use, the flexible portion 18 may be flexed outward to fit partially around the circular lens holding ring 22 on the flashlight 10. The holding ring 22 contains protruding dimples 24 which are positioned to be received by opposing holes 20 in the flexible portion 18 when such portion is position about the holding ring 22. The flexible portion has spring tension memory so that it is held in place on the holding ring 22 with the aid of the dimple and hole arrangement described. In this embodiment, the holding means may be attached to the flashlight in one of two position; either to hold the document within the light of the flashlight or folded back/reversed to either function as a belt clip to suspend the flashlight or at least moved out of the way. As shown, the holding means is in a position ready for attachment of a document in the path of the light of the flashlight 10. The gripping member is shown as a spring tension clip for holding an item in place. Of course, any other suitable gripping member may be used in this or in the other embodiment of the present invention including adhesive means, velcro fasteners, clasps, clamps and the like.

Figure 2:
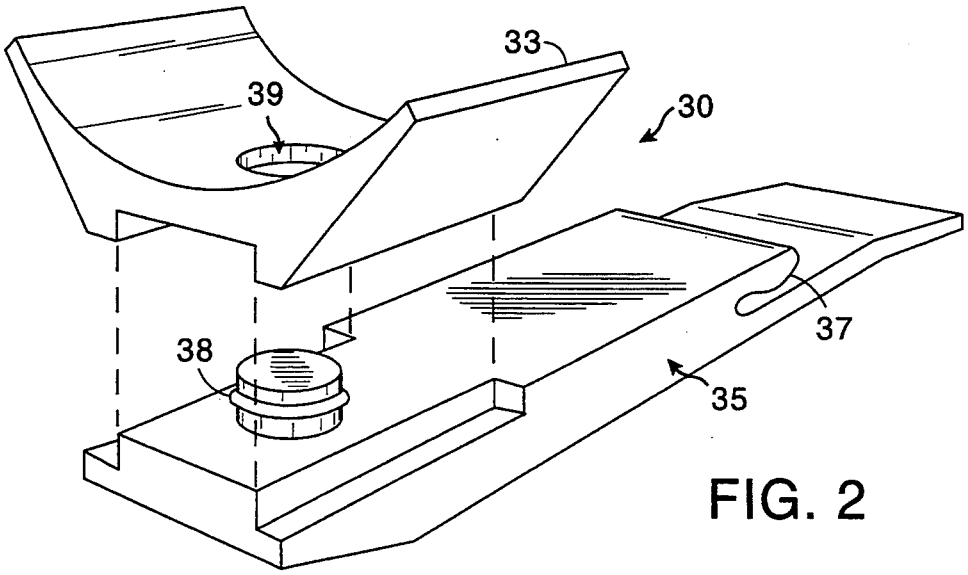
FIG. 2 is a perspective view depicting a two piece document holding device according to the present invention.
Figure 3:
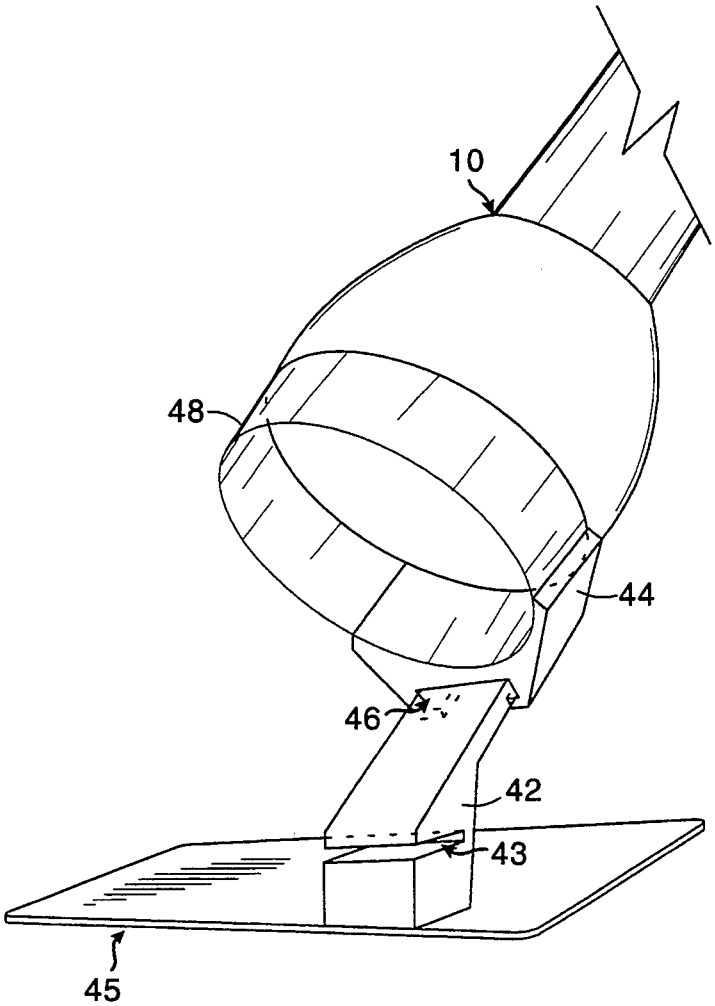
FIG. 3 is a perspective view depicting another two piece document holding device according to the present invention.

In another embodiment, shown in FIG. 2, the holding member 30 comprises a support member 33 and a detachable gripping member 35 having a grooved portion 37 for receiving a document. The detachable gripping member may be attached to the support member 33 by means of a snap closure mechanism composed of dimple 38 mounted on the gripping member and receiving hole 39 positioned on the support member 33. Although not shown this particular holding means may be mounted onto the circular portion of the lens end of a flashlight by, for example, adhesively securing it thereto. FIG. 3 shows such a mounting arrangement although the holding means is slightly different from the one shown in FIG. 2.

In the embodiment in FIG. 3, the gripping member 42 is slidably mounted in the support member 44 in a manner which permits it to be moved backwards and forwards in a receiving hole 46 in the support member 44. The support member 44 and gripping member 42 comprise the holding means which is mounted by suitable means such as adhesives to the lens holding rim 48 of the flashlight 10. The gripping member contains a slot 43 which positioned for receiving a document 45. The slot is oriented so that the document 45 receives the slanted rays of the light emitted from the flashlight 10 without reflecting those rays back into the eyes of the user. In a device such as the one shown in FIG. 3 the gripping means can be adjustably positioned and enable a document to be held at various angles to and distances from the light.

Figure 4:
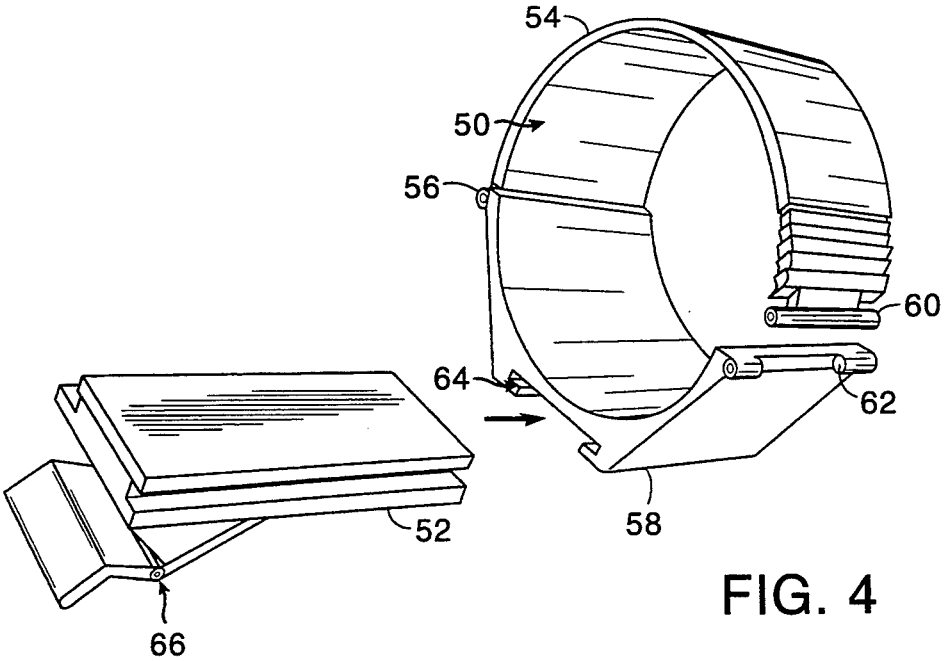
FIG. 4 is a perspective view depicting still another two piece document holding device according to the present invention.

In still another embodiment shown in FIG. 4, the holding means comprises a support member 50 and a detachable gripping member 52. The support member generally comprises a circular hinged clasp containing a first hinged member 54 connected by means of hinge 56 to a second hinged member 58. The first hinged member 54 contains a clasp 60 for connection to a clasp receiving member 62 on the second hinged member 58. In use, the hinged clasp may to be mounted about the circular illuminating end of the flashlight by opening the hinged clasp and closing it around the flashlight and securing the clasp. The second member hinged 58 contains a receiving member 64 for receiving the gripping member 52 which may be slidably mounted therein. The gripping member 52 contains a hinged clip 66 for holding an item.

Figure 5:
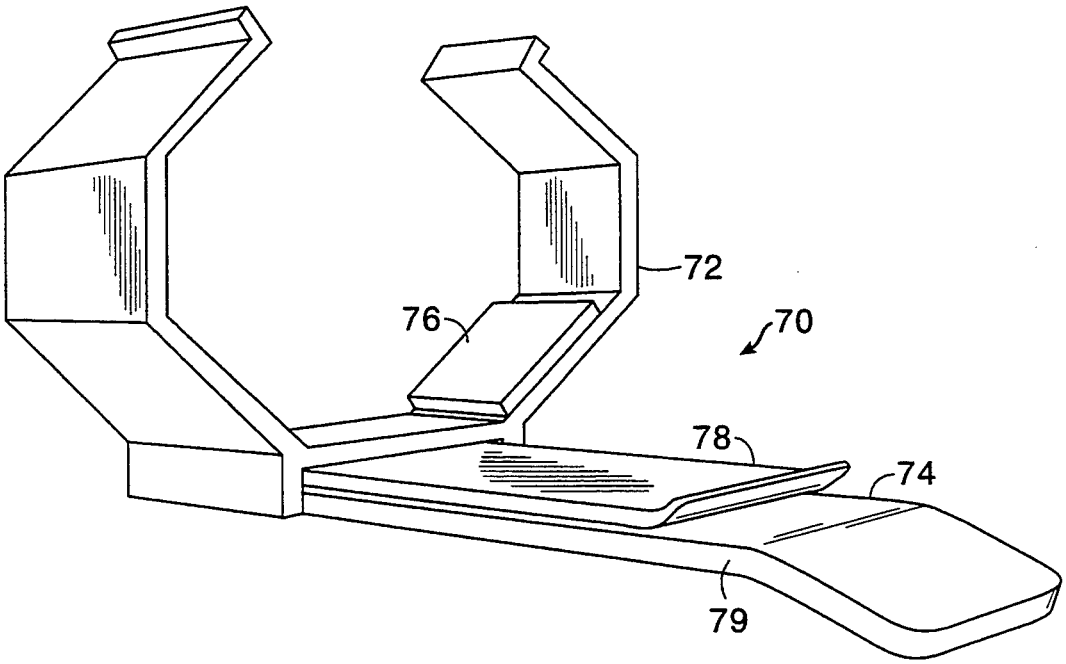
FIG. 5 is a perspective view of another embodiment according to the present invention.

In another embodiment shown in FIG. 5, the currently most preferred embodiment, the holding means comprises a support member 72 and a gripping member 74 attached thereto. The support member 72 is configured to be placed partially around the lens end or body of the flashlight. To keep the support member in place on the flashlight a friction pad 76 such as rubber pad is disposed on the inner surface of the support member 72. One or more such pads may be so used. The gripping member 74 is composed of a 2 piece clip having an upper clip member 78 and a lower clip member 79. A document can be positioned between the upper and lower members and held in place. Preferably, the upper and lower members are made from a transparent material such as LEXAN$^r$ which enables the user to read that portion of the document held between the two members.

In still another embodiment (not shown), the holding means may comprise bristles which may be mounted on the illuminating end of the flashlight such as on the outer surface of the flashlight and extend beyond the illuminating end of the flashlight and parallel thereto. The bristles perform as a gripping means in that a planar document may be mounted between the bristles and held in position.

In general any suitable material may be used to form the holding means of the present invention such as plastic, metal and metal alloys. The gripping member is preferably made from a material that is transparent such as a transparent plastic like LEXAN$^r$ which facilitates the reading of the text document by the user by eliminating any obstruction of text on the document by the gripping means.

Although a number of embodiments have been shown it will be appreciated that various other conventional means of attaching the gripping member, support member and flashlight to each other may be used including welding, screws, rivets, nuts and bolts and the like.

What is claimed is:

1. A flashlight for holding and illuminating a document comprising a flashlight and a means attached directly to the flashlight for holding the document in a position so that it may be illuminated by the flashlight; wherein the flashlight has a first end and a second end, an illuminating means positioned at the first end; said holding means comprising a support member and a gripping member attached directly thereto, said support member being connected directly to the first end of the flashlight wherein the holding means is detachably connected to the flashlight in two different orientations, said orientations being a first orientation in which the gripping member extends beyond the first end of the flashlight in a direction opposite to the second end of the flashlight for illuminating a document attached thereto and a second orientation in which the gripping member extends towards the second end of the flashlight in a position suitable for attachment to a belt.

2. The flashlight of claim 1, wherein the gripping means is a clip.

3. The flashlight of claim 1, wherein the flashlight is a hand-held flashlight.

4. The flashlight of claim 1, wherein the holding means is adjustable.

* * * * *